US006810541B1

(12) United States Patent
Woods

(10) Patent No.: US 6,810,541 B1
(45) Date of Patent: Nov. 2, 2004

(54) PEANUT-SHAPED PRAYER CUSHION

(76) Inventor: Rosalind G. Woods, 1875 S. Redondo Blvd., Los Angeles, CA (US) 90019

( * ) Notice: Subject to any disclaimer, the term of this patent is extended or adjusted under 35 U.S.C. 154(b) by 0 days.

(21) Appl. No.: 10/659,378

(22) Filed: Sep. 11, 2003

(51) Int. Cl.[7] ..... A47C 20/02
(52) U.S. Cl. ..... 5/420; 5/636
(58) Field of Search ..... 5/420, 630, 636; 182/230; 2/24; D6/601; 128/892, 894

(56) References Cited

U.S. PATENT DOCUMENTS

| | | | | |
|---|---|---|---|---|
| D236,063 | S | | 7/1975 | Kesh |
| D302,592 | S | | 8/1989 | Holmes |
| D313,141 | S | | 12/1990 | Witter et al. |
| D314,116 | S | | 1/1991 | Reed |
| 5,148,564 | A | * | 9/1992 | Reder ..... 5/636 |
| 5,313,678 | A | * | 5/1994 | Redewill ..... 5/639 |
| D377,130 | S | | 1/1997 | Dorrer |
| D391,112 | S | | 2/1998 | Houston |
| 5,926,880 | A | * | 7/1999 | Sramek ..... 5/636 |
| D417,997 | S | | 12/1999 | Yannakis |
| D439,099 | S | | 3/2001 | Erickson |
| D439,342 | S | | 3/2001 | Seip, Jr. |
| 6,438,779 | B1 | | 8/2002 | Brown |
| 2003/0005521 | A1 | | 1/2003 | Sramek |
| 2003/0019007 | A1 | | 1/2003 | Spencer |

* cited by examiner

*Primary Examiner*—Teri Pham Luu
*Assistant Examiner*—Fredrick Conley
(74) *Attorney, Agent, or Firm*—Richard C. Litman

(57) ABSTRACT

A peanut-shaped cushion is to be used to enhance the comfort of a person kneeling in prayer. The pillow is constructed from a single piece of thick foam material. The opposite ends of the foam are rounded. The mid-section is narrowed so that the foam piece resembles a peanut. The foam is wrapped with a polyester fiber cover and further disposed in a decorative casing, which casing is zippered for easy removal. The casing has a small pocket on one of its planar sides.

9 Claims, 5 Drawing Sheets

PEANUT-SHAPED PRAYER CUSHION

BACKGROUND OF THE INVENTION

1. Field of the Invention

The present invention generally relates to protective devices. More particularly, the present invention is drawn to a cushion or pillow adapted to protect the knees of a worshiper who is kneeling for prayer.

2. Description of the Related Art

Many religious services require that worshipers assume a kneeling position while participating in prayer. Even in private, many people believe that proper reverence requires that prayers should be offered from a kneeling position. Unfortunately assuming the above-stated position can cause discomfort to the knees. This is especially true for older persons and those who may suffer from arthritis or other muscle/joint ailments. The art would certainly welcome a utilitarian pillow or cushion that would eliminate or lessen discomfort so that a supplicant could concentrate on the task at hand, prayer.

The related art is rife with pillows of various designs that are adapted to enhance user comfort. For example, U.S. Pat. No. Des. 236,063 (Kesh), Des. 314,116 (Reed), Des. 391,112 (Houston) and Des. 417,997 (Yannakis) show ornamental designs for pillows, which pillows are configured in a shape similar to that of the pillow of the instant invention. However, the above cited ornamental pillows apparently make no provision for enhanced comfort for the knees of a kneeling user.

U.S. Pat. No. Des. 302,592 (Holmes) and D439,099 (Erickson) disclose pillows designed for therapeutic use. The pillows include features that would not be suitable for a religious setting.

U.S. Pat. No. 6,438,779 B1 (Brown) and patent application publication numbered 2003/0005521 A1 (Sramek) are drawn to pillows for separating the knees of a person while the person is lying on his/her side.

U.S. Pat. No. Des. 313,141 (Witter) discloses a pillow having a pocket on one surface thereof. The pillow is adapted for use by a sleeping child and the pocket is employed to contain a tooth for the tooth fairy.

U.S. Pat. No. Des. 377,130 (Dorrer), D439,342 S (Seip, Jr.) and patent application publication numbered 2003/0019007 A1 (Spencer) disclose knee cushions. The cushions include no structure that would make them especially adaptable to a person engaged in prayer.

None of the above inventions and patents, taken either singly or in combination, is seen to disclose a peanut-shaped prayer pillow as will subsequently be described and claimed in the instant invention.

SUMMARY OF THE INVENTION

The instant invention is a peanut-shaped cushion to be used to enhance the comfort of a person kneeling in prayer. The pillow is constructed from a single piece of thick foam material. The opposite ends of the foam are rounded. The mid-section is narrowed so that the foam piece resembles a peanut. The foam is wrapped with a polyester fiber cover and further disposed in a decorative casing, which casing is zippered for easy removal. The casing has a pocket on one of its planar sides with a phrase "For Your Prayers" imprinted thereon. The pocket is adapted to contain prayer cards therein.

Accordingly, it is a principal object of the invention to provide a knee cushion, which cushion is effective to enhance the comfort of a person kneeling in prayer.

It is another object of the invention to provide a knee cushion, which cushion is configured in an efficient shape.

Still another object of the invention is to provide a knee cushion, which cushion is sealed against the intrusion of moisture and dirt It is a further object of the invention to provide a knee cushion, which cushion is enclosed in a removable, decorative casing.

It is an object of the invention to provide improved elements and arrangements thereof for the purposes described which are inexpensive, dependable and fully effective in accomplishing their intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
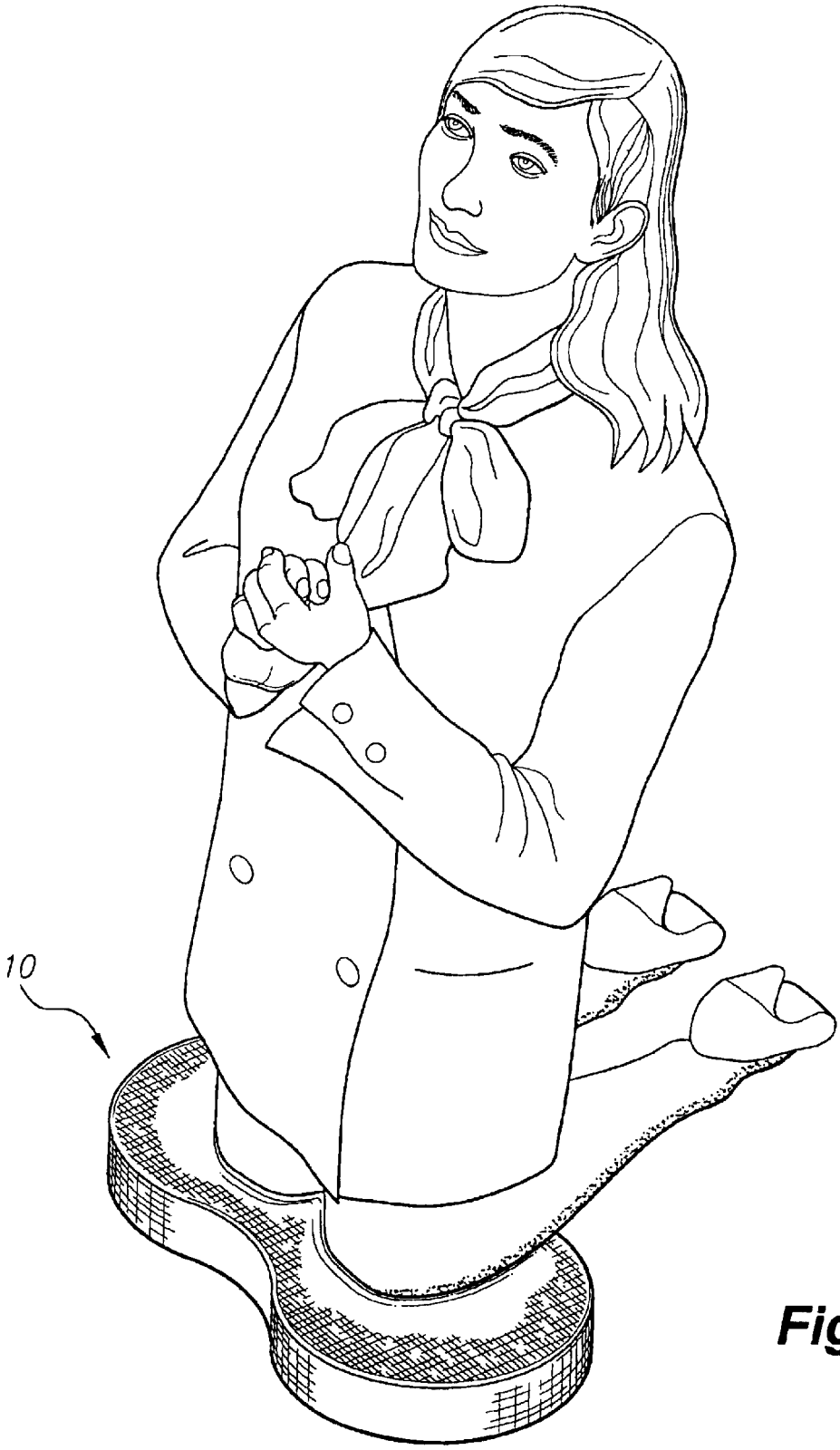
FIG. 1 is an environmental, perspective view of a peanut-shaped prayer cushion according to the present invention.

As illustrated in FIG. 1, the cushion of the instant invention is indicated generally at 10. As discussed above, cushion 10 is to be employed to enhance comfort to the knees when a user assumes a kneeling position.

Figure 2:
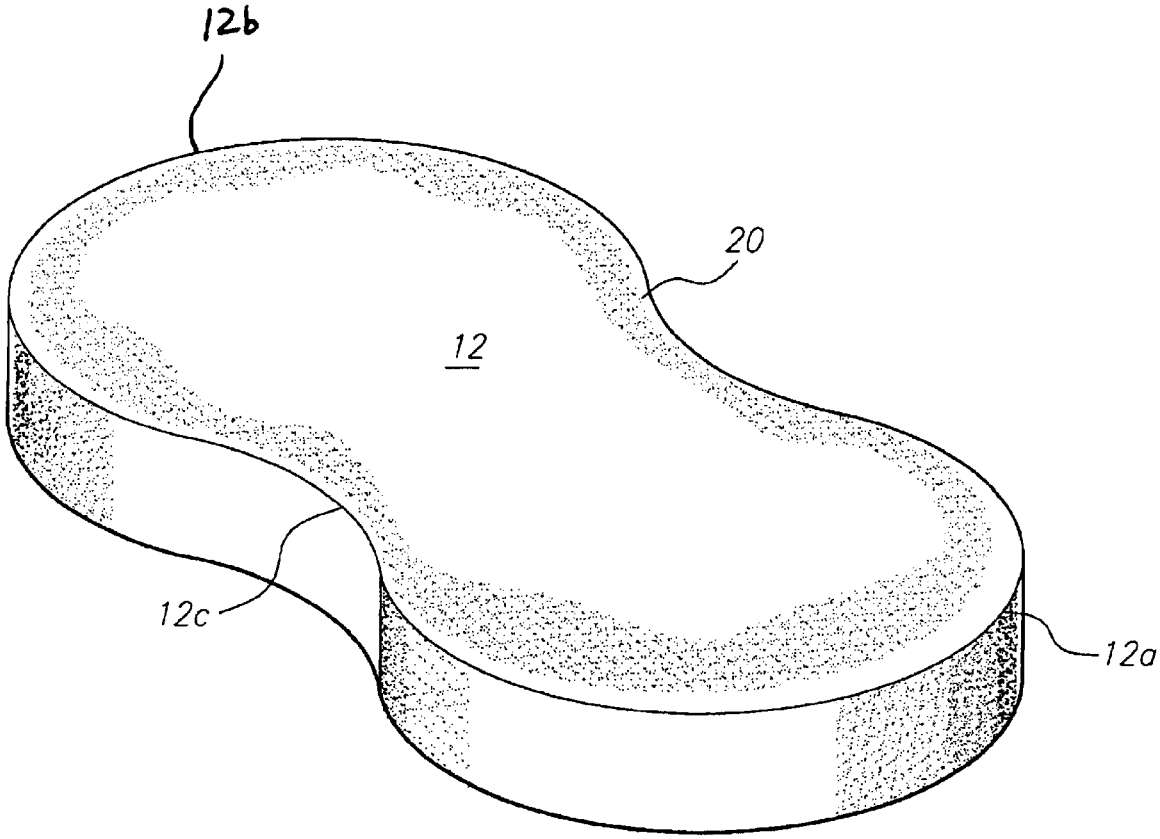
FIG. 2 is a perspective view of a foam insert for a peanut-shaped prayer cushion according to the present invention.

As best seen in FIG. 2, the cushion is fabricated from a high-density foam insert 12. As contemplated, insert 12 is approximately two inches thick and twenty-one inches long. The insert 12 is identically rounded at both ends 12*a* and 12*b*. Ends 12*a* and 12*b* are ten and one-half inches wide at their widest point. The ends taper to a mid-portion 12*c*, which mid-portion is approximately seven and one-half inches wide. The above dimensions will give the insert 12 a configuration that resembles a peanut. The increased width at ends 12*a*, 12*b* results in a larger knee-contact area. The tapered mid-portion 12*c* makes the cushion easy to handle.

Figure 3:
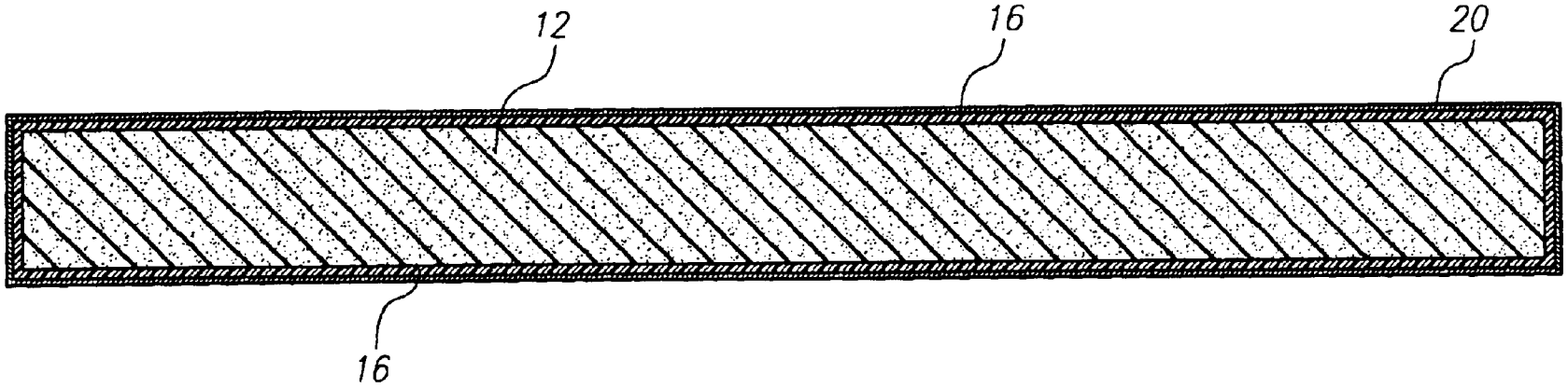
FIG. 3 is a cross-sectional view of the insert wrapped in polyester material according to the present invention.
Figure 4:
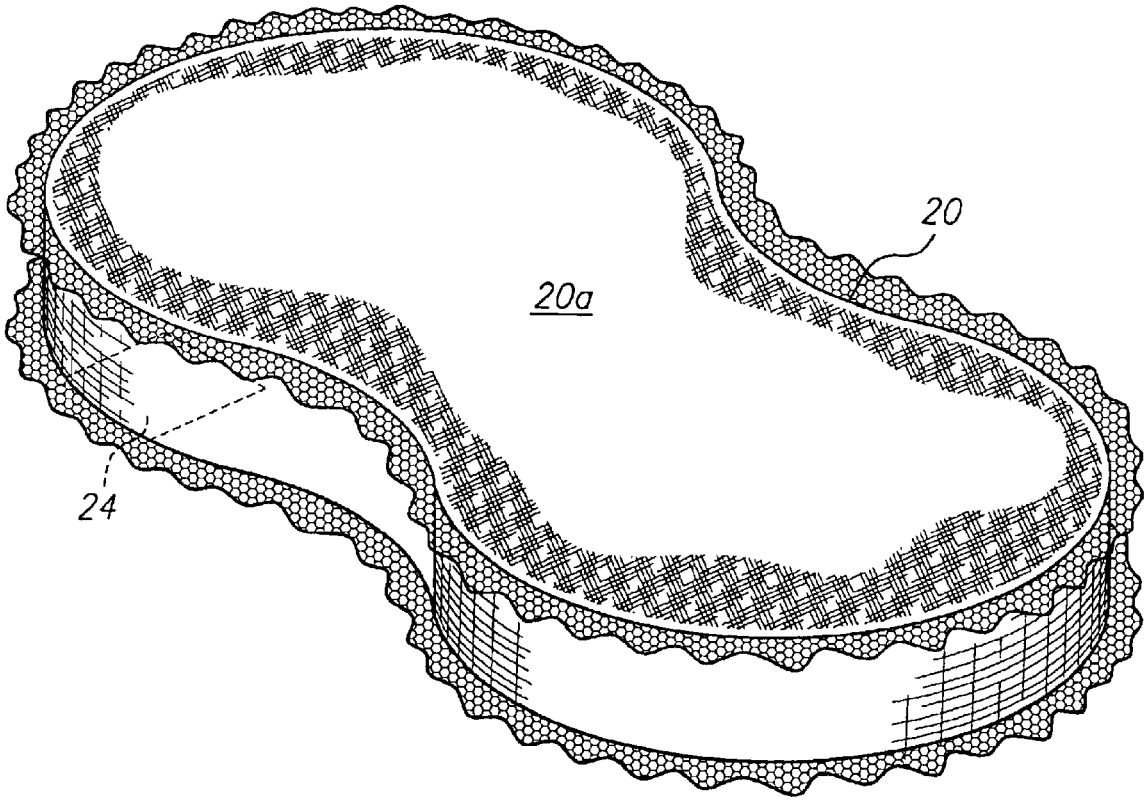
FIG. 4 is a perspective view of a peanut-shaped prayer cushion encased in a decorative casing according to the present invention as seen from the front.
Figure 5:
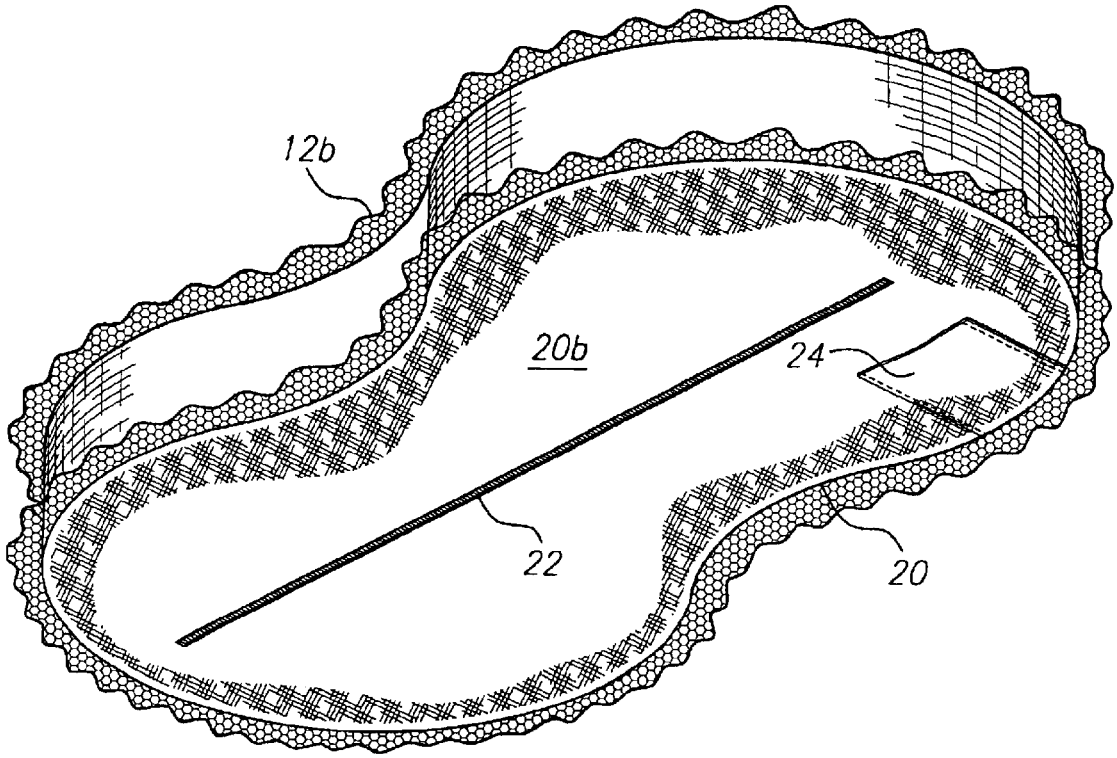
FIG. 5 is a perspective view of a peanut-shaped prayer cushion encased in a decorative casing according to the present invention as seen from the rear.

Attention is now directed to FIG. 3 wherein insert 12 is enclosed in a wrap 16. Wrap 16 is fabricated of polyester material. Insert 12 is sealed in the polyester wrap by any convenient means (gluing, sewing, etc.). Polyester wrap 16 functions to protect the insert 12 from moisture and dirt. The wrap 16 also adds additional padding for comfort and may have a second layer in the knee contact or top surface. The wrapped insert 12 is now disposed in a decorative casing 20. As best seen in FIGS. 4 and 5, casing 20 is fabricated from a soft, washable material having front and rear planar surfaces 20*a*, 20*b*. The casing 20 is configured in a peanut-shape and can be manufactured in a variety of designer colors and fringed-patterns to appeal to the varied aesthetic tastes of potential users. The front planar surface 20*a* is smooth so as to present an unencumbered surface for the knees. A zipper 22 is positioned on rear planer surface 20*b* so that casing 20 may be easily removed for washing or replacing. Although a zipper is preferred, buttons or hook and loop fasteners may be used if desired. A small four and one-fourth by four inch pocket 24 is attached to the rear planar surface. The pocket is adapted to hold selected prayer cards and/or small items of choice. The pocket may be inscribed with desired decorative indicia.

It is to be understood that the present invention is not limited to the embodiments described above, but encompasses any and all embodiments within the scope of the following claims.

I claim:

1. A prayer cushion, comprising:

an insert member, the insert member having rounded first and second ends, the ends tapering to a mid-portion, the insert member being configured in a peanut-shape, wherein said insert member is fabricated from high density foam;

at least one layer of a flexible wrap material, the insert member being encased and sealed in said flexible wrap material;

a soft, decorative casing, the casing being configured in a peanut-shape; and means for removably inserting the insert member inside the decorative casing.

2. The prayer cushion as recited in claim 1, wherein said flexible wrap material is fabricated from a polyester material.

3. The prayer cushion as recited in claim 1, wherein said decorative casing has a planar rear face and said means for removably inserting includes a zippered opening on said planar rear face.

4. The prayer cushion as recited in claim 3, further including a small pocket attached to said planar rear face.

5. A prayer cushion, comprising:

an insert member fabricated from high-density foam, the insert member having rounded first and second ends, the ends tapering to a mid-portion, the insert member being configured in a peanut-shape;

at least one layer of a flexible, polyester wrap material, the insert member being encased and sealed in the wrap material;

a soft, decorative casing, the casing being configured in a peanut-shape; and means for removably inserting the insert member into the decorative casing.

6. The prayer cushion as recited in claim 5, wherein said decorative casing has a planar rear face and said means for removably inserting includes a zippered opening on said planar rear face.

7. The prayer cushion as recited in claim 6, further including a small pocket attached to said planar rear face.

8. The prayer cushion as recited in claim 5, wherein said insert member has a length of approximately twenty-one inches and a thickness of approximately two inches.

9. The prayer cushion as recited in claim 8, wherein said first and second ends respectively have a width of approximately ten and one-half inches and said mid-portion has a width of approximately seven and one-half inches.

* * * * *